United States Patent [19]

Osteen

[11] 4,365,786

[45] Dec. 28, 1982

[54] CONSTRUCTION MOVING, POSITIONING AND HOLDING TOOL

[76] Inventor: James L. Osteen, 2012 Jeridona, LaMarque, Tex. 77568

[21] Appl. No.: 211,420

[22] Filed: Nov. 28, 1980

[51] Int. Cl.[3] ..... E21B 19/00

[52] U.S. Cl. ..... 254/30; 254/129; 254/130; 254/131; 254/132; 269/43

[58] Field of Search ..... 254/30, 31, 129–132, 254/12; 269/49, 43; 30/96–99

[56] References Cited

U.S. PATENT DOCUMENTS

| | | | |
|---|---|---|---|
| 274,584 | 3/1883 | Furman | 254/120 |
| 336,189 | 2/1886 | White | 254/131 |
| 475,665 | 5/1892 | Chalfant | 248/157 |
| 557,259 | 3/1896 | Donnelly | 254/131 |
| 631,954 | 8/1899 | Csorba | 248/157 |
| 755,057 | 3/1904 | Shafer et al. | 414/680 |
| 780,038 | 1/1905 | Huntington | 254/131 |
| 788,738 | 5/1905 | Thomas | 254/31 |
| 930,755 | 8/1909 | Holland | 30/97 |
| 1,074,974 | 10/1913 | Olson | 254/132 |
| 1,505,970 | 8/1924 | Powell | 254/131 |
| 2,212,564 | 8/1940 | Hord | 30/98 |
| 2,341,106 | 2/1944 | Kuzela | 254/30 |
| 2,394,265 | 2/1946 | Seamans | 29/267 |
| 2,511,657 | 6/1950 | Welch | 254/132 |
| 3,055,090 | 9/1962 | Murphy | 269/49 X |
| 3,975,003 | 8/1976 | Buford | 30/97 X |
| 4,250,769 | 2/1981 | Herring | 254/129 X |

*Primary Examiner*—Frank T. yost

*Attorney, Agent, or Firm*—Vaden, Eickenroht, Thompson, Bednar & Jamison

[57] ABSTRACT

A construction tool for moving, positioning and holding a workpiece, such as a pipe or beam, or the like, relative to a selected work area, which may be the earth's surface, a pipe, a beam or other type of support. The tool includes a base, an upright support, a swivel, a pivoted lever and anchor means for securing the lever in a predetermined attitude relative to the upright support. The base in a selected form is readily interchanged with the upright support by a telescoping joint secured by a pin. This pin joint allows several extended positions of the upright support relative to the base for easy height adjustment. A universal swivel joint atop the upright support mounts the pivoted lever. The length of the lever at its mounting to the swivel head may be readily adjusted between selected lengths. One end of the lever is secured to the workpiece, e.g., by a chain, and the other end of the lever is secured by an anchor chain to the base to maintain it in a desired attitude.

9 Claims, 12 Drawing Figures

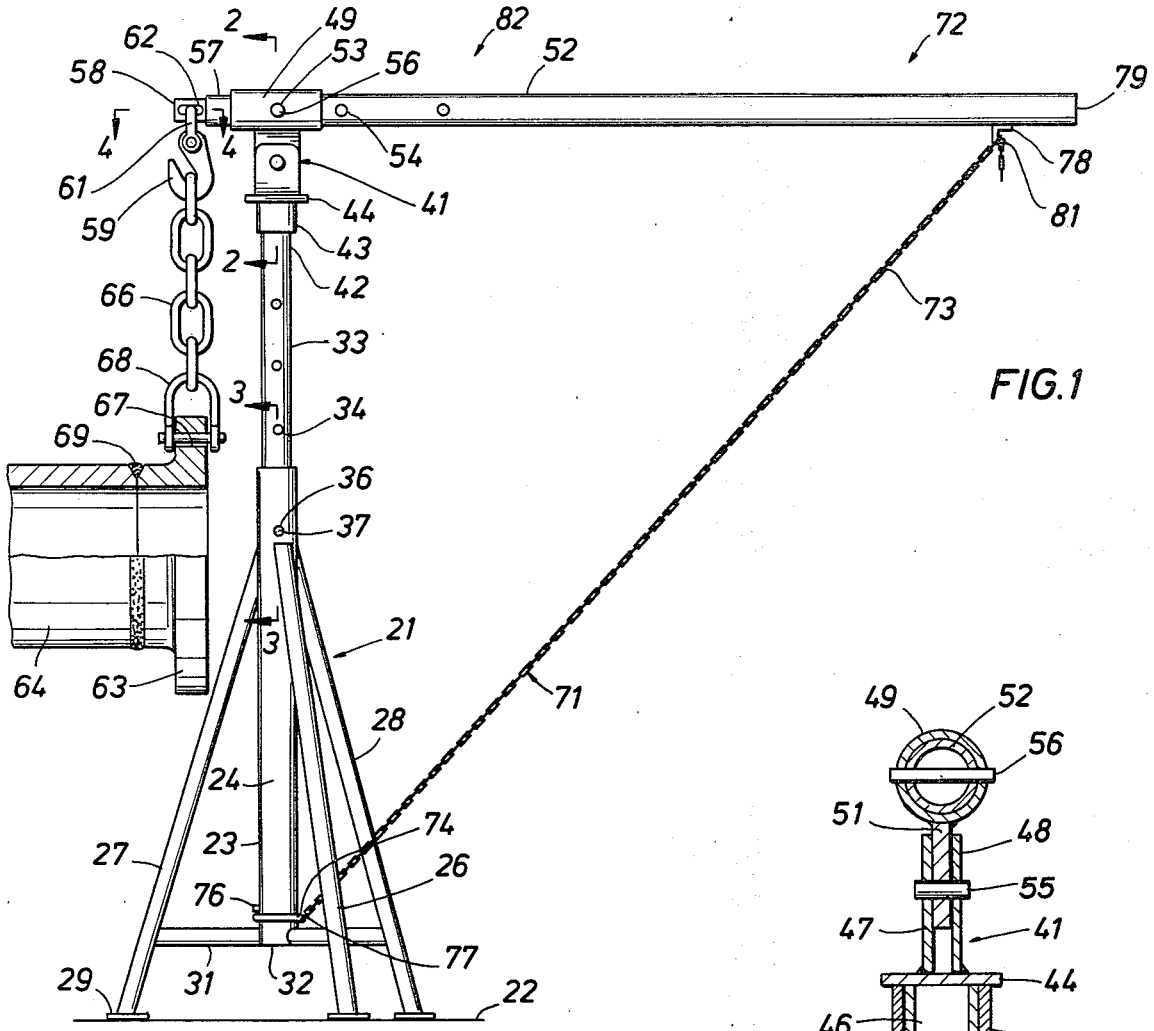
FIG. 1
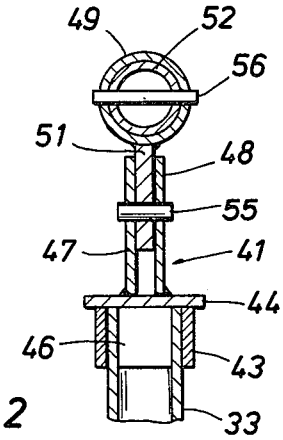
FIG. 2
FIG. 3
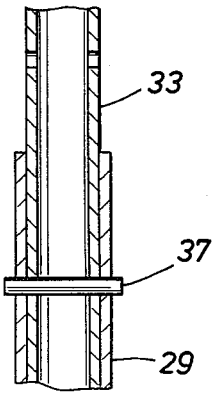
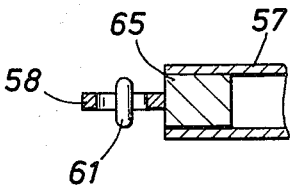
FIG. 4

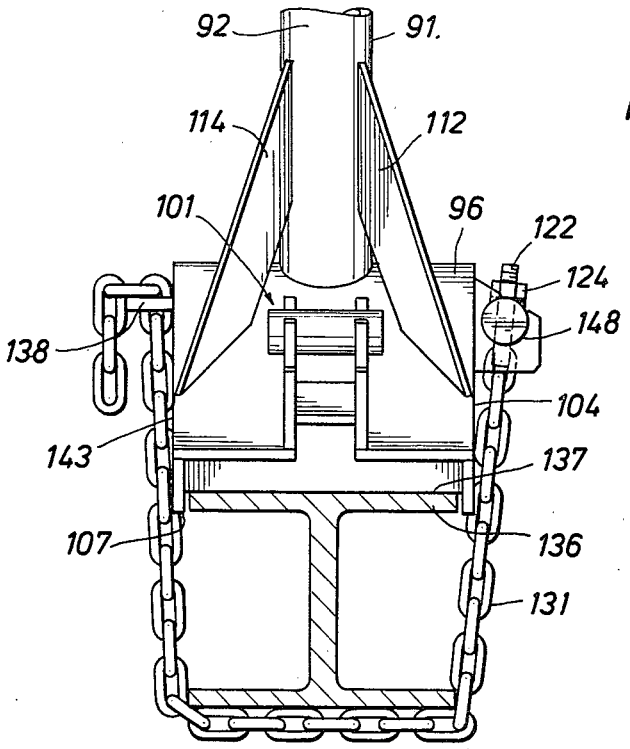
FIG. 7
FIG. 8
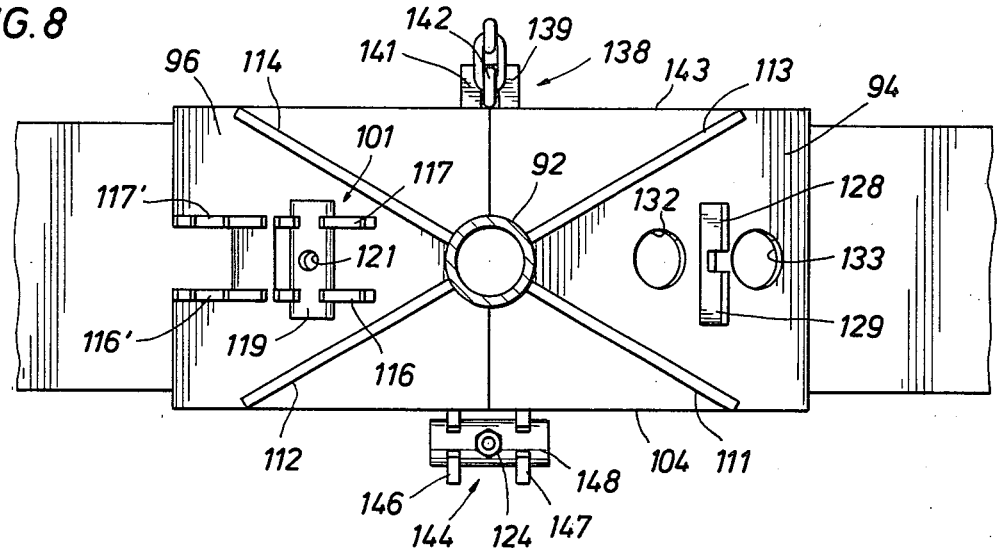
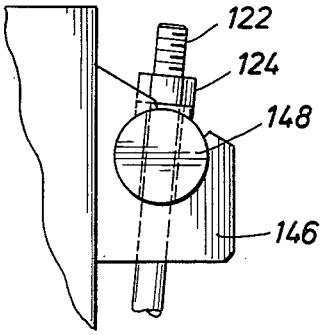
FIG. 9
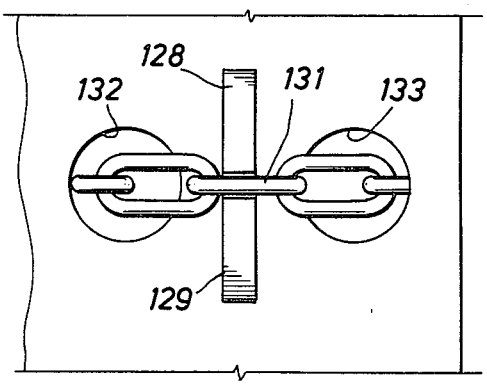
FIG. 10

FIG. 11
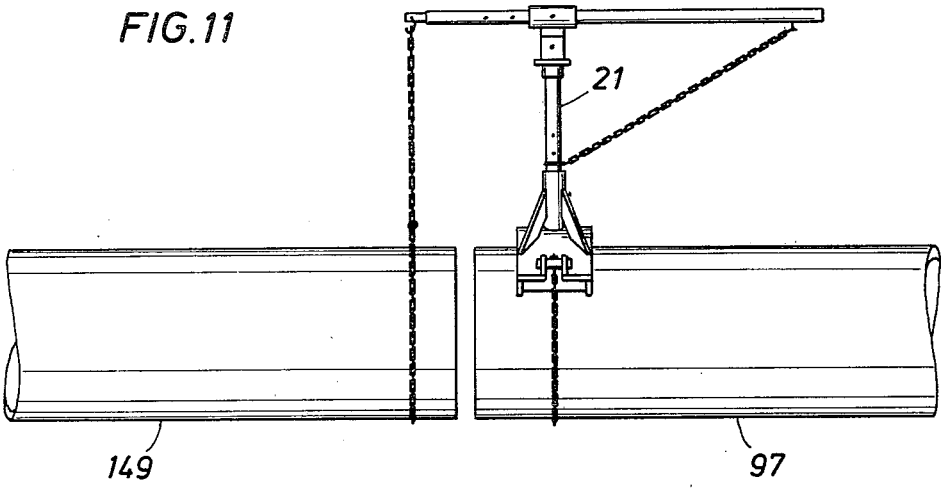
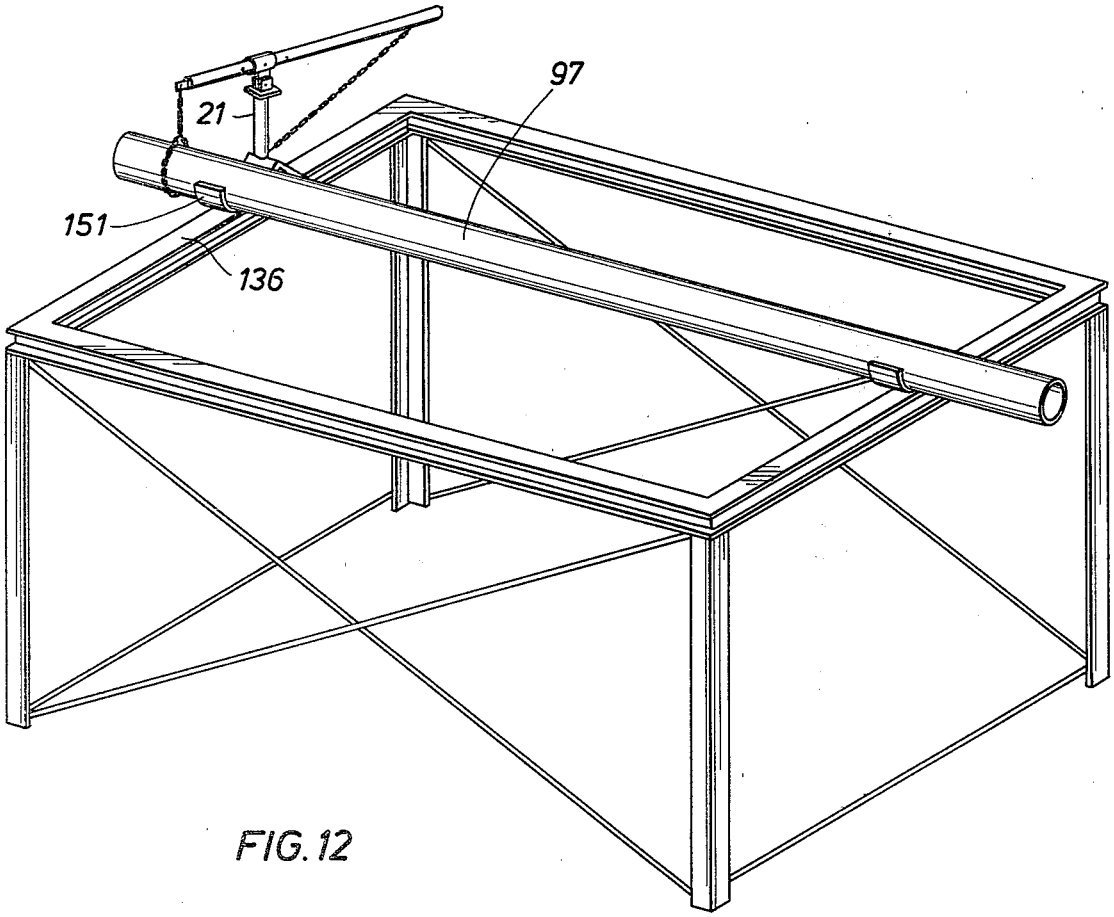
FIG. 12

CONSTRUCTION MOVING, POSITIONING AND HOLDING TOOL

BACKGROUND OF THE INVENTION

1. Field of the Invention

This invention relates to construction tools and more particularly, it relates to construction tools that are adapted for moving, positioning and holding a workpiece relative to a selected work area.

2. Description of Prior Art

Various types of tools have been proposed for many years to facilitate the supporting, pushing and pulling, moving, positioning of workpieces relative to a work area. For example, the most common type of tool for this purpose is a jack which may be mechanical or hydraulic in operation. It will be apparent that the jack can move a work piece from a work area along one axis. Generally, the jack does not permit the workpiece to be rotated or moved angularly from the axis of movement of the jack. In like manner, various types of levers and prying bars have been proposed for the use in moving a workpiece in a work area. Other types of lifting devices have been a combination of the jack and the lever combined in such a fashion that the workpiece could be moved relative to the work area in one or two axis and held there manually while another function was performed on the workpiece.

These prior tools, in general, have been found inadequate wherein a workpiece of relatively great weight and size must be moved manually and within very small work areas. For example, in oil refineries and chemical plants it is quite common to have to replace a relatively large valve which may weigh, for example, 800 to 1000 pounds in a work area of a few square feet wherein only two or three workmen can conveniently perform. Usually, these areas are such that it is impossible to employ a power mechanism such as a motor crane or hydraulic lift or the like. In such instances, the workers have to manually support the valve upon a timber rack with or without jacking means to disconnect the valve, and then to move it to a position where the power equipment can grasp the valve and move it to a desired location. Reinstallation of such a valve requires a reverse of these working steps. It is quite apparent that it involves substantial physical endeavor and can be quite dangerous especially in wet surroundings.

In many instances, one pipe will have to be joined to another as by welding. For example, when a new valve or the like is to be placed into an existing piping assembly, cuts are made in the pipe and a section is removed from it. Then, flanges must be welded to the ends of the pipe for the interconnection of a valve or other pipe element into the piping assembly. For example, it is quite difficult to make connections into pipes of 8 to 12 inches in diameter which require the welding onto their ends of flanges that may weigh in the region of a thousand pounds or more. The positioning of such a flange at the end of a pipe, and especially in close quarters, is a very difficult, hard, physical task. Generally, the flange is raised by jacks to some position, then supported upon a timber platform and then welded into place. The final weld must be made in difficult quarters because the timbered support obstructs the circumferential connection of the flange to the pipeline.

In similar manner, there are many other instances where a heavy and hard to handle workpiece must be positioned at some attitude and height relative to a work surface, which may be the earth, a platform, a pipe or beam or like structure above the earth surface. It would be most advantageous to use a tool that avoids the dangerous and physical nature of conventional jacking and prying tools presently employed in the construction industry.

In accordance with the present invention, there is provided a construction tool which avoids all the difficulties with the prior devices. The tool can be used upon any selected workpiece whether the earth surface, a pipe or beam or other work area above the earth's surface. The tool is readily operated by one or two workers to move, position and hold a workpiece in a given attitude relative to the work area. More particularly, this construction tool has the ability to move a workpiece in all three planes and then hold it in a given position. In addition, the tool is readily arranged with several bases for mounting upon pipes, beams or other flat surfaces. It may be disassembled for transport or movement into a very compact work area and then readily assembled by a single operator. Other features of the present invention will be apparent from the following description of this invention.

SUMMARY OF THE INVENTION

In accordance with this invention, there is provided a tool for moving, positioning and holding a workpiece relative to a selected work area. The tool includes a wide stance base, operably positioned on the selected work area. An upright extension extends from the base and it is secured to it at predetermined positions. A head is mounted atop the upright support by a universal journal means that provides for rotating the head about the axis of the upright extension and also to pivot it transversely thereto. An operating lever intermediate its ends, is mounted to the head. A workpiece support is carried at one end of the lever. A hand gripping portion is provided at the other end of the lever. An anchor mechanism extends between the base in the other end of the lever for retaining the lever in a selected attitude relative to the upright extension. The lever has a mounting on the head so that the length of the lever between the head and the workpiece support can be adjusted between several predetermined positions. With this arrangement of the tool, a workpiece can be moved in three planes relative to a selected work area and then held at a desired position conveniently and safely, even in very compact work areas, by a very limited number of workers.

DESCRIPTION OF THE DRAWINGS

In the drawings, the several embodiments of the present tool have like elements and functions for the moving, positioning and holding of a workpiece relative to a selected work area. In regard to the several following Figures, like elements in the tool will carry like numerals to simplify description of the several embodiments of the present construction tool.

FIG. 1 is an elevation showing a first embodiment of the present construction tool holding a flange in position for welding onto the end of a large pipe;

FIG. 2 is a vertical section taken through the universal swivel connection between the head carrying the lever and the upright support of the tool;

FIG. 3 is a vertical section taken through the base and upright support of the construction tool;

FIG. 4 is a horizontal section taken through the workpiece support carried on one end of the lever of the construction tool;

FIG. 6 is a partial elevation of a second embodiment of the present tool and in particular a novel base that is readily mounted in any attitude upon a pipe, a beam or a flat plate surface or the like;

FIG. 7 is a partial side view of the tool shown in FIG. 6;

FIG. 8 is top plan view of the base of the tool shown in FIG. 6;

FIG. 9 is a section taken along line 9—9 of FIG. 6;

FIG. 10 is a section taken along line 10—10 of FIG. 6;

FIG. 11 is a prospective view showing the tool of FIG. 6 mounted upon a pipe with the tool supporting a second piece of pipe adjacent thereto for welding purposes; and FIG. 12 is a view of the tool of FIG. 6 mounted upon the flat beam surface of a pipe support rack and holding pipe to install supporting shoes.

DESCRIPTION OF PREFERRED EMBODIMENTS

Figure 5:
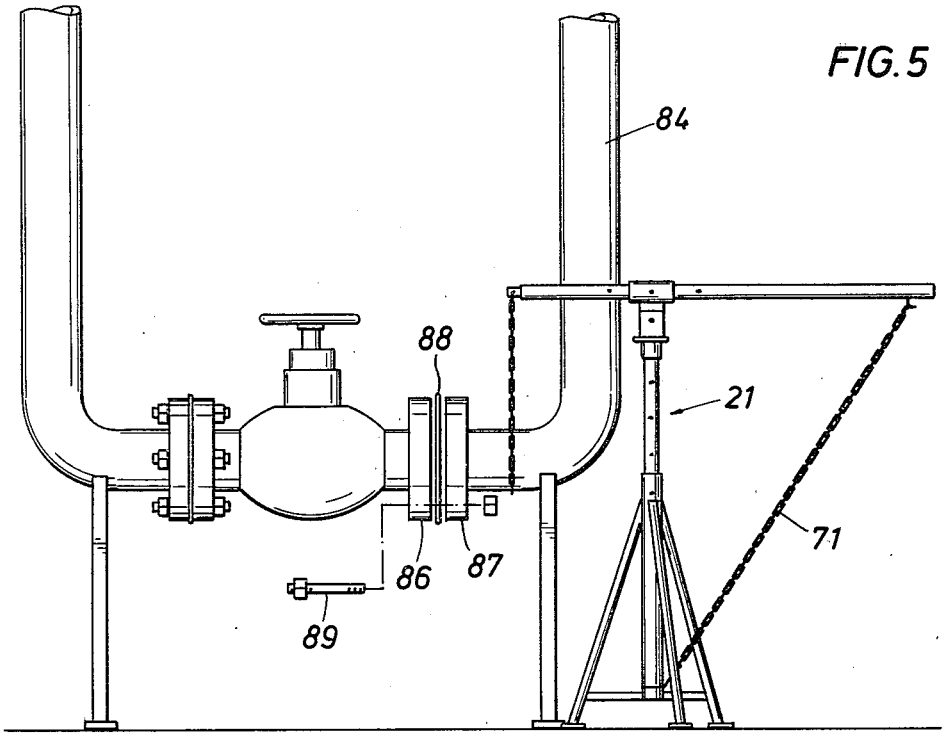
FIG. 5 is a prospective illustrating the construction tool in its use to align a pipe assembly and valve.

Referring now to FIG. 1, there is shown an embodiment of the construction tool 21 which is adapted to rest upon a horizontal supporting work area 22 which may be the earth's surface or a platform such as a steel plate, or some other rigid, flat surface. The tool 21 has a wide stance base 23 having a tubular support 24 on which are mounted divergent legs 26, 27 and 28. Preferably these legs are positioned equiangularly about the support 24 and carry foot pads 29 at their lower extremities to rest upon planar surfaces forming the work area 22. Stub braces 31 extend between the legs and the lower extremity 32 of the tubular upright support 24. The upper ends of the legs are welded to the tubular support 24 near its top most portion. An upright tubular extension 33 is telescoped within the support 24 of the base 23. The extension carries a plurality of holes 34 which are complimentary to the hole 36 within the support 24. As reviewed in FIG. 3, a pin 37 is passed through the holes 36 and 34 whereby the extension 33 may be secured at a plurality of heights relative to the base 23. Other means besides the pin 37 and the cooperative holds may be employed for securing the upright tubular extension at predetermined positions within the base 23. A head 41 is mounted by means of a universal joint atop the upper end 42 of the extension 33. The upper end 42 of the extension 33 as can be seen more clearly in FIG. 2, carries an encircling ring 43 about the upper portion 42 as a reinforcement for the universal joint.

The head 41 carries a plate 44 which forms a horizontal bearing surface for rotation atop the ring 43. In addition, a downwardly projecting pin 46 extends from the plate 44 into the opening within the tubular extension 33. Preferably, the fit of the pin 46 is relatively close so that there is a reasonably tight bearing by which the head 41 may rotate about the axis of the upright extension 33.

The head 41 additionally carries a swivel arrangement so that a movement transverse to the support 33 can be obtained. For this purpose a pair of upstanding plates 47 and 48 are carried upon the plate 44. A tubular socket 49 is connected to a lug 51 which extends downwardly between the plates 41 and 48. A pin 55 extends through suitable openings in the plates 47 and 48 and the lug 51. As a result, the tubular head 49 may be rocked or moved transversely to the axis of the support 33. Preferably, the pin 55 as well as the pin 37 are readily removed from their respective openings to permit a ready disassembly of the head 41 and the extension 33 from the base 23.

A tubular operating lever 52 is telescoped or mounted within the socket 49. For this purpose, the socket 49 is provided with an opening 53 which is complimentary to a plurality of openings 54 that extend partially along the length of the lever 52. A pin 56 is passed through these openings to mount the lever 52 along predetermined positions within the socket 49. As a result, the leverage provided by the lever 52 may be varied within certain predetermined important limits, as will be more apparent from the following description, and to provide a desired fulcrum for raising a workpiece. As shown in FIG. 4, one end 57 of the lever 52 carries a support 58 for engaging the workpiece. For this purpose, a hook 59 may be provided and mounted by means of a shackle 61 within an elongated opening 62 within the support 58. The support 58 may be connected to a workpiece by any suitable means.

As can be seen in FIG. 1, in an example, the workpiece may take the form of a forged steel flange 63 with a welding neck which can be butt welded to a pipe 64. For example, the pipe 64 may be mounted some distance above the work surface 22 in a pipe rack or the like. It is desired to mount the flange 63 onto the end of the pipe 64. For the purpose, the flange 63 is grasp by the hook 58 using a chain 66 that is connected through one of the bolt holes 67 with a releaseable shackle 68. By means of the lever 52, the flange 63 is moved from a side loading surface which may be from the end of a fork lift truck or the like, and then swung about the rotary joint provided by the pin 46 within the end of the extension 33. The base 23 of the tool 21 is positioned so that as the flange is swung into position at the end of the pipe 64, it will be within the desired distance from the pipe permitting its ready welding thereto. The lever 52 is manipulated to coaxially align the flange 63 with the pipe 64. At that time, a welder may provide a welded bead 69 between the welding neck of the flange 63 and the end of the pipe 64.

Although the flange 63 could be held manually at the desired position, the tool 21 is provided with an anchor means so that the lever 52 can be held in a desired attitude with the flange 63 coaxially aligned with the pipe 64 and without operator attention. For this purpose, there is provided an adjustable anchor 71 which extends between the hand grip portion 72 of the lever 52 and the base 23. In one form of the anchor 71, it may consist of a chain 73 which is carried upon a swivel ring 74 held at adjacent the bottom of the base 23 by a lug 76 secured in the tubular support 24. The chain is secured to the ring 74 by an ear 77 so that it may rotate about the axis of the tubular support 24. The chain 73 is interconnected to the hand grip portion 72, by a suitable means which permits a ready adjustment of its length and thereby setting the attitude of the lever 52. For this purpose, there may be provided a jay hook 78 adjacent the end 79 of the lever 52. Preferably, the jay hook extends downwardly a sufficient distance to make it convenient to hook one of the loops 81 of the chain 63 about the projecting end of the hook 78. As a result, when the workpiece, such as flange 63 is at the proper orientation, the chain 73 is connected through a suitable loop 81 to the hook 78. As a result, the lever 52 will be maintained in the desired attitude for maintaining the workpiece position relative to the work area 22.

In addition, the hook 78 provides another novel function. The tool 21 must be designed with a safe load limit such that it cannot be overloaded inadvertantly or deliberately. One of the arrangements for this result is the wide stance of the legs 26–28, such that the tool will not tip and thereby prevent the raising of a heavy workpiece. In addition, if the workpiece such as flange 63 is between the legs of the base 23, the lever 52 in the safety portion 82 between the socket 49 and the end 79 is designed of a beam strength such that it will bend before a sufficiently excessive mass can be lifted by the support 58. In this manner, an excessive unsafe load cannot be raised which would collapse the tool 21. For this purpose, it is preferred that the lever 52 be made of a selected tubular material which will bend in the safety portion 82 should an excessively heavy mass be raised. In addition, the lever 52 is provided with the hook 78 nearest its end 79 which prevents the telescoping over the end 79 of the lever 52 of a pipe or other tubular member which in the trade is known as "a cheater." Thus, the operators have to apply the lifting force by grasping directly the hand grip portion 72. For example, the tool 21 in the maximum lift leverage that can be obtained where the lever is in the first of the holes 54 within the tubular sockets 49, the safety portion 82 will bend upon, for example, a load of 2000 pounds being applied to the work support hook 59. Thus, with the arrangement shown a maximum of 2 or 3 operators putting their pulling weight upon the hand grip portion 72 cannot overload the tool 21 by providing an excess downward force in a swinging motion of the lever 52 towards the base 23. Thus, the hook 78 provides another safety feature for the tool 21 in addition to the safety portion 82 forming a part of the lever adjacent the tubular socket mounting to the head 41.

The arrangement of the support 58 may be seen by momentary reference to FIG. 4. There, the support 58 is secured to a plug insert 65 which is welded within the end 57 of the tubular lever 52. Other arrangements for mounting the support 58 into the lever 52 may be provided as is apparent.

Referring to FIG. 5, there is shown one use of the tool 21 for aligning flange connections between a valve 83 being replaced within a piping assembly 84. One end of the valve has been assemble to one portion of the piping 84 through the usual gasket and bolting arrangement. At its other end, the valve has a flange 86 which will be connected to the piping flange 87 with a joint seal provided by a gasket 88. For this purpose, the tool 21 is employed to bring the flange 87 into alignment with the flange 86 to receive the through bolts 89. Then, the bolts are tightened to form a fluid tight joint. The tool 21 can be arranged to be used in the lifting, positioning and holding of the flange 87 in a proper position relative to the valve 86 for making the ultimate joint. Additionally, it will be apparent that the tool could be positioned to move the valve adjacent to the flange 86 for the same purpose. The positioning of the tool 21 will depend upon which of the piping assembly members needs to moved into alignment, the valve or the flange, to make the ultimate joint.

In many instances, the tool 21 must be used in work areas such that the surface 22 of the work area is not horizontal, or it may be round or of other shapes. For this purpose, the embodiment of the tool shown in the remaining Figures of the drawings is well adapted for use. In this embodiment of the tool 21, only the base 23 has been replaced by a different base 91 which is so arranged as to be readily mounted upon a flat surface, a pipe of varying diameter, a beam of various sizes or other surface whether planer, cylindrical, elongated or angular. Thus, the base 91 is very advantageous for use in the compact work areas such as found in an oil refinery or chemical plant, and in particular, in working with large pipes, beams and like massive work pieces.

Figure 6:
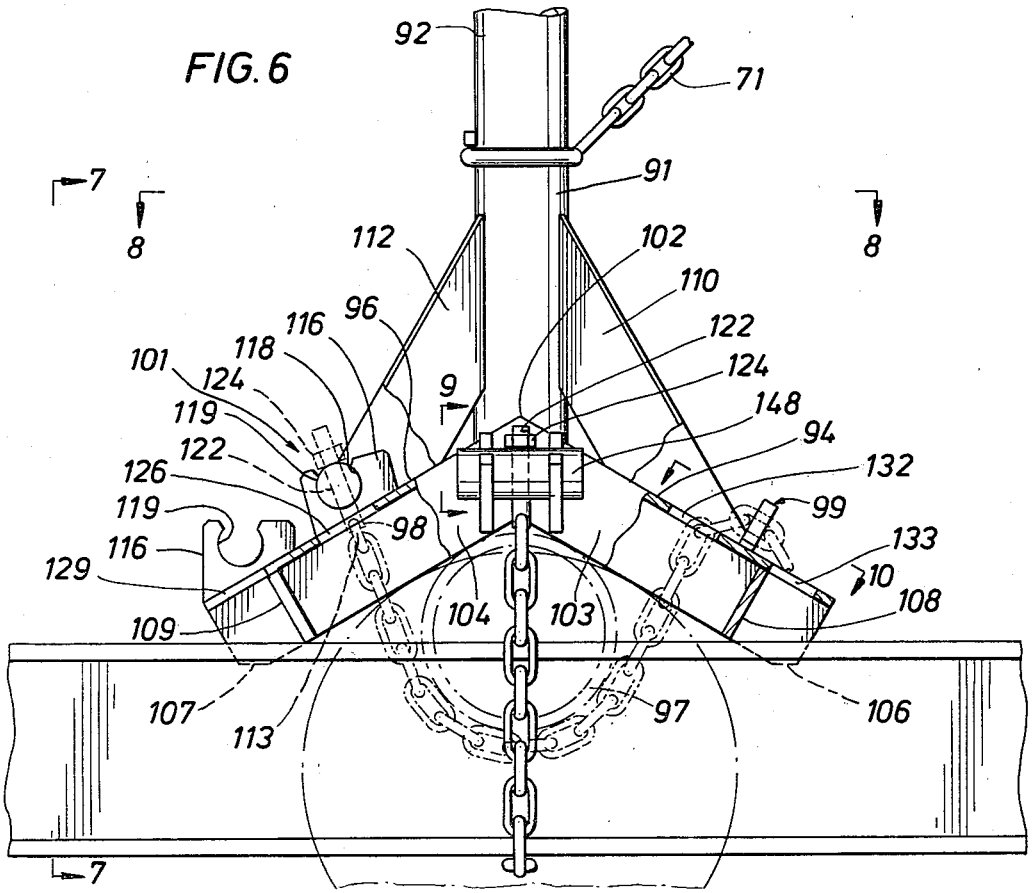

More particularly, the base 91 has an upright tubular support 92 which carries a hole 93 for engaging the pin 37 whereby the upright extension 33 may be mounted at any desired height. The remaining superimposed portion of the tool 21 is the same for the embodiment shown in FIG. 1. The base 91 has divergent legs 94 and 96. The legs 94 and 96 extend at equiangles from the tubular support 92 to form a saddle mount for receiving, as a work area 22, a beam, pipe or other elongated or angular surface. More particularly, as seen in FIG. 6, the work area is a pipe 97 which is secured to the legs by an anchor means. For example, the anchor may be a chain 98 which extends about the pipe from a hook mounting 99 to a threaded screw tensioner arrangement 101.

More particularly, the legs 94 and 96 may be constructed using channel iron members. In reference to FIG. 6 and FIG. 8 one channel member forms leg 94 and the other channel member forms leg member 96. The channel members are welded together at their apex 102 and have downwardly projecting sides 103 and 104. Preferably, the lower edges of these sides are flat and fall in a common plane to form mounting surfaces 106 and 107. In addition, the interior portion of the legs are stiffened by transverse braces 108 and 109. In addition, the legs are stiffened by fillets 110–114 that are welded between the legs and the tubular support 92.

The base 91 is arranged to received a variety of pipe sizes as the work area and to be securely mounted to them. This mounting is secure irrespective of whether the base is in an upright or some angular orientation relative to the earths surface. For this purpose, the anchor supports accomodate a variety of pipes and yet to engage them in a securing mode to provide the greatest rigidity between the pipe and the base 91. More particularly, the leg 96 is provided with a unique form of the screw tensioner assembly 101. More particularly, each screw tensioner assembly is provided by upright plates 116 and 117 which are secured to the top surface of the leg. The supports are provided with a transverse passageway or openings 118 in which is supported a barrel 119. The barrel 119 is sized so as to be slideably and rotatably mounted within the upright supports 116 and 117. The barrel 119 carries a transverse opening 121 in which is received a screw tensioner. Preferably, the screw tensioner is provided by an eye bolt 122 which carries at one end an eye or loop 123 in which is secured an end link of the chain 98. The other end of the eye bolt 122 is threaded to receive a nut 124. With the eye bolt received within the opening 121, it is obvious that screwing the bolt 124 on a threaded portion thereof will cause the chain to be pulled transversely relative to the barrel 119. An opening 126 is provided within the leg 96 for the positioning of the eye bolt 122.

The other end of the chain 98 is secured within a hook assembly 99. More particularly as shown in FIG. 10, the hook assembly 99 is comprised of a pair of upstanding plates 128 and 129 which are spaced apart a sufficient distance to accomodate a link 131 of the chain when it is aligned upright between them. As a result, the next transverse position link of the chain will rest against the face of these plates to securely anchor that end of the chain to the leg 94. An opening 132 is provided adjacent the plates for the chain to pass upwardly from beneath the leg and between the plates.

With this arrangements of the chain hook assembly 99 and the screw tensioner assembly 101, the base 91 is placed upon top of the pipe 97 and the chain 98 is passed about the pipe and through the opening 132 between the plates 128 and 129 where it is hooked. The nut 124 is threaded onto the eye bolt 122 until the chain is pulled into sufficient tension to securely mount the base 91 upon the pipe 97. Since the barrel 119 can rotate within its mounting on the leg 96, and the chain can extend in various attitudes through the openings 132 from the hook assembly 99, the chain will always be in tension substantially normal to the surface of the legs 94 and 96.

If the size of the pipe becomes relatively large compared to the pipe 97, such as the pipe shown in chain line, then the chain 98 can be moved outwardly along the legs to a more distant position. For this purpose, a duplicate of the screw tensioner 101 is provided near the ends of the legs 96. In this arrangement, the elements are the same and are designated by a prime where they are in duplicate. A second opening 129 is formed in the leg 96 immediately below the outward positioning of the screw tensioner assembly 101. In similar fashion, a second opening 133 is provided in the leg 94. Then, the chain will extend from the screw tensioner mounted in barrel 119 (held in supports 116 and 117) through the opening 129 and pass about the larger diameter pipe and then upwardly through the opening 133 to again be secured within the chain hook assembly 99. By this arrangement, it will be apparent that the base 91 can be readily mounted upon a variety of sizes of pipes and yet be rigidly secured thereto in any desired attitude with the chain held in its most strongest position, that is normal to the surfaces of the respective legs.

In addition, the base 91 may be mounted either transversely or parallel upon the surface of a beam 136 or the like. As can be seen in FIG. 7, the base 91 is mounted upon a large I beam 136. For this purpose, the braces 108 and 109 of the legs rest directly upon the top surface 137 of the beam. The side surfaces of the legs engage the top sides of the beam 136. The base 91 is held to the beam 136 by any suitable means such as an anchor arrangement described for securing the base to the pipe 97. For this purpose, the side 143 of the leg 96 is provided with a chain hook 138. The chain hook is formed substantially like the chain hook assembly 99 and is formed of two spaced plates 139 and 141 which are spaced apart a distance to receive edgewise the link 142 of the chain. Thus, the loose end of the chain 98 may be passed between the plates and hooked in a manner as previously described for the chain hook 99. The opposite side 104 of the base 91 is provided with a screw tensioner assembly 144 that is very similar to the screw tensioner assembly 101. As best seen in FIG. 9, there are provided parallel supports 146 and 147 which have a transverse opening through them to receive a barrel 148 which receives the eye bolt 122. The nut 124 is adjusted to place the chain 98 in sufficient tension to rigidly secure the base 91 to a beam 136 or other angular structure.

It will be apparent that the base 91 may be placed transversely upon the beam as is shown for the pipe 96 in FIG. 6. Now, the chain 98 would be passed about the beam exactly in the same manner as is shown with the pipe 97 in FIG. 6.

The use of the tool 21 with the base 91, to hold large pipes is readily appreciated by viewing FIG. 11. In FIG. 11, the tool 21 is mounted upon the pipe 97. The lever 52 is used to support a second pipe 149 which is held in alignment with the pipe 97 so that the two can be moved first into butted alignment, and then secured as by welding. It can be seen that because of the saddle mount of the tool 21, this particular butt to butt alignment of pipe is readily obtained. In a similar fashion, any pipe element could be held in the position of the pipe 149 and the same work arrangement produced.

In addition, the tool 21 can be mounted with the base 91 transversely upon an I beam 136 which is part of a steel rack for supporting a plurality of pipes. This arrangement is shown in FIG. 12 where the tool 21 is used to lift slightly the pipe 97 to a clearance of the beam 136 where a new saddle 151 can be installed beneath it.

From the foregoing, it will be apparent that there has been provided a novel tool which is well adapted for use in the construction, agriculture and other industries where a workpiece can be moved in three planes into a desired position and then held there safely and securely. It will be apparent that certain changes or alterations in the present tool may be made without departing from the spirit of this invention. These changes are contemplated by, and are included within the appended claims which define the invention. Additionally, the present description is intended to be taken as an illustration of this invention.

What is claimed is:

1. A manual tool for moving, positioning and holding a workpiece relative to a selected work area comprising;

(a) a wide stance base operably positioned on the selected work area and said base having a tubular support with divergent legs carrying flat surfaces adapted to rest upon planar surfaces on a work area;

(c) a tubular upright extension received within said tubular support on said base;

(d) pin means cooperating with openings in said upright extension and said tubular support for securing said upright extension at predetermined positions within said base;

(e) a head mounted atop said upright support, said head carrying a pin received within the end of said upright extension whereby said head can rotate about the axis of said extension, and said head carries a tubular socket interconnected by a pivoted joint to said pin whereby said tubular socket can pivot transversely to said upright extension;

(f) a tubular operating lever intermediate its first and second ends within said socket, a workpiece support means provided at the first end of said lever and a hand gripping portion provided at the second end of said lever;

(g) anchor means extending between said base and the second end of said lever for retaining said lever in a selected attitude relative to said upright extension;

(h) pin means cooperating with openings in said tubular socket and said lever whereby the length of said lever between said head and said workpiece support means can be adjusted between several predetermined positions; and (i) said lever adjacent said tubular socket carries a safety portion adapted to bend before sufficient force can be applied to said hand grip portion to exceed the safe load limit of the tool.

2. The tool of claim 1 wherein said base has three divergent legs spaced equiangularly about said tubular support, and said anchor means includes an anchor mounted on said tubular support to receive one end of a chain extending to a hook carried adjacent the second end of said lever.

3. The tool of claim 1 wherein said hook and chain are positioned closely adjacent the second end of said lever and thereby prevent the telescoped mounting on said lever at such end of a tubular member (i.e. a cheater) to increase leverage by the user of the tool.

4. The tool of claim 1 wherein said base has an opposite pair of divergent legs which extend at equal angles from said upright extension forming a saddle mount for receiving a pipe as the work area and releaseable means carried by said base for securing rigidly said base to said pipe irrespective of its size or attitude.

5. The tool of claim 4 wherein said releaseable means comprise a chain extending from a first anchor on one leg pair about the pipe and to a second anchor on the other leg pair, one end of said chain by releaseably hooked and the other end of said chain being connected to a threaded screw tensioner.

6. The tool of claim 5 wherein said first anchor comprises spaced supports including openings receiving a barrel, said barrel provided with a transverse opening to receive said threaded screw tensioner and the second anchor comprises an opening transversed by said chain and parallel ears to releaseably secure said chain.

7. The tool of claim 5 wherein said first anchor comprises first and second swivel mounts to receive said threaded screw tensioner with said mounts spaced apart on one leg pair, and each swivel mount provided by spaced supports having an opening receiving a barrel that carries a transverse opening to receive said threaded fastener and said second anchor comprises a pair of spaced openings in the other leg pair with parallel ears between said openings to releaseably secure said chain whereby a pipe of small diameter in said saddle mount is secured by said chain extending between the under spaced barrel and opening whereby said chain extends about each pipe between said leg pairs substantially at right angles to them.

8. The tool of claim 1 wherein said base has a pair of channel members diverging at equal angles from said upright extension and said channels have ends forming flat mounting surfaces for resting upon a work area formed by a beam or the like.

9. The tool of claim 8 wherein said anchor means comprise first and second anchors carried on opposite ends of said base, said first anchor comprises spaced supports including openings to receive a barrel, and said barrel provided with a transverse opening to receive a threaded screw tensioner, and said second anchor comprises parallel ears to releaseably secure one end of a chain that extends about the beam or the like and terminates at said screw tensioner.

* * * * *